United States Patent [19]

White

[11] 4,022,105

[45] May 10, 1977

[54] AUTOMATIC WEAPON FIRING MECHANISM

[75] Inventor: Doyle L. White, Davenport, Iowa

[73] Assignee: The United States of America as represented by the Secretary of the Army, Washington, D.C.

[22] Filed: Sept. 27, 1976

[21] Appl. No.: 726,884

Related U.S. Application Data

[63] Continuation-in-part of Ser. No. 610,024, Sept. 3, 1975, Pat. No. 3,999,461.

[52] U.S. Cl. ..... 89/149; 89/185
[51] Int. Cl.[2] ..... F41D 3/06; F41D 11/16
[58] Field of Search ..... 89/149, 159, 172, 185

[56] References Cited

UNITED STATES PATENTS

| | | | |
|---|---|---|---|
| 2,950,653 | 8/1960 | Harvey | 89/185 |
| 2,965,005 | 12/1960 | Reed | 89/149 |

*Primary Examiner*—Stephen C. Bentley
*Attorney, Agent, or Firm*—Nathan Edelberg; Harold H. Card, Jr.; Robert O. Richardson

[57] ABSTRACT

An automatic weapon firing mechanism consisting of a slideably movable bolt carrier with cam slots cooperating with pins on the bolt and firing pin for rotating the bolt to lock it in battery position for firing and to cock the firing pin during recoil. Continued forward movement of the carrier after the bolt is locked causes the firing pin to sear off and strike the chambered cartridge. The firing pin has its own firing spring so that a constant reliable striking force is applied to the cartridge. Gas from the spent cartridge recoils the bolt carrier, unlocking the bolt and cocking the firing pin during recoil.

8 Claims, 5 Drawing Figures

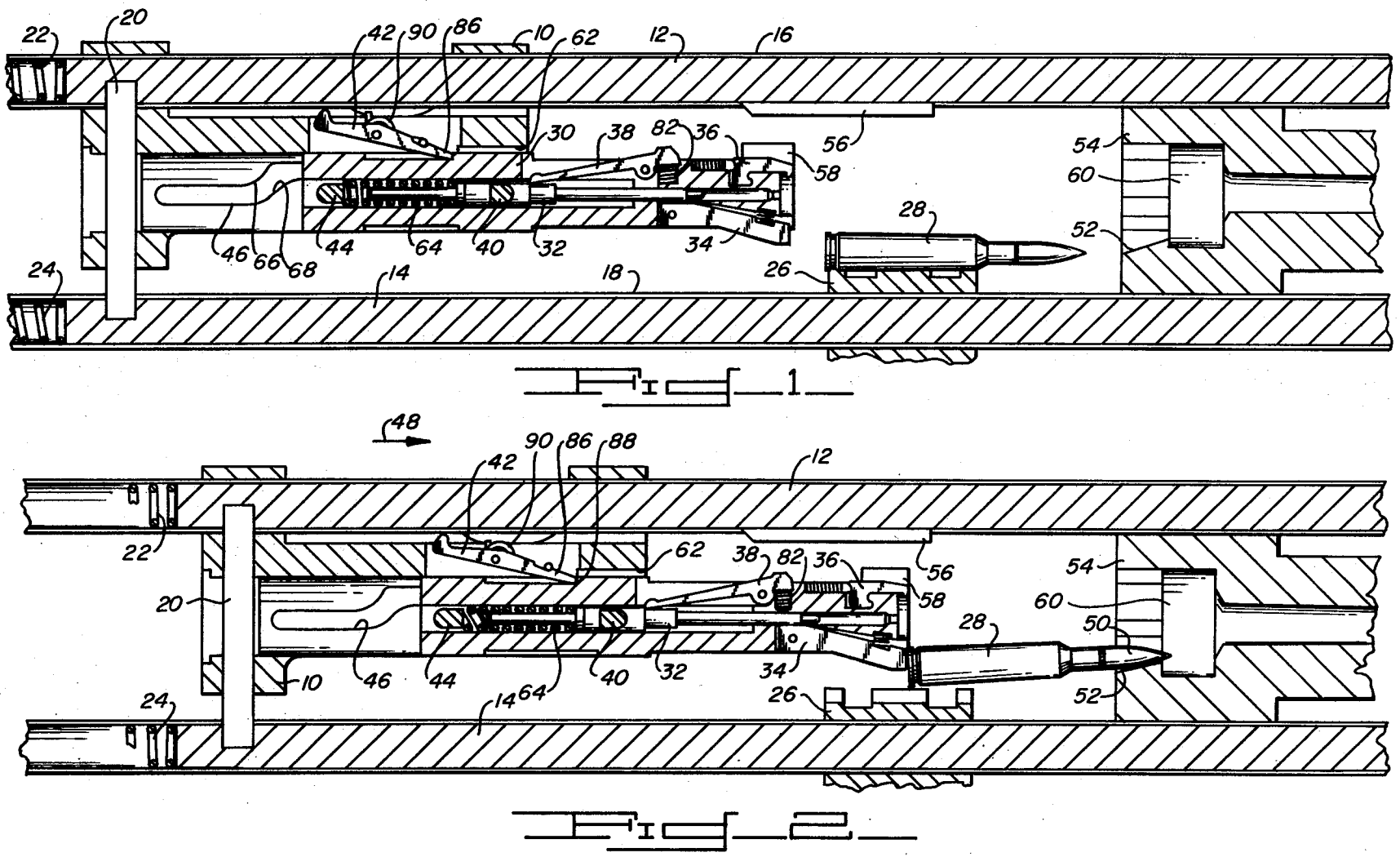
54
60
52
28
56
58
16
26
36
34
12
82
38
18
62
10
30
32
86
40
90
64
42
14
44
68
66
46
20
22
24
1
50
48
2

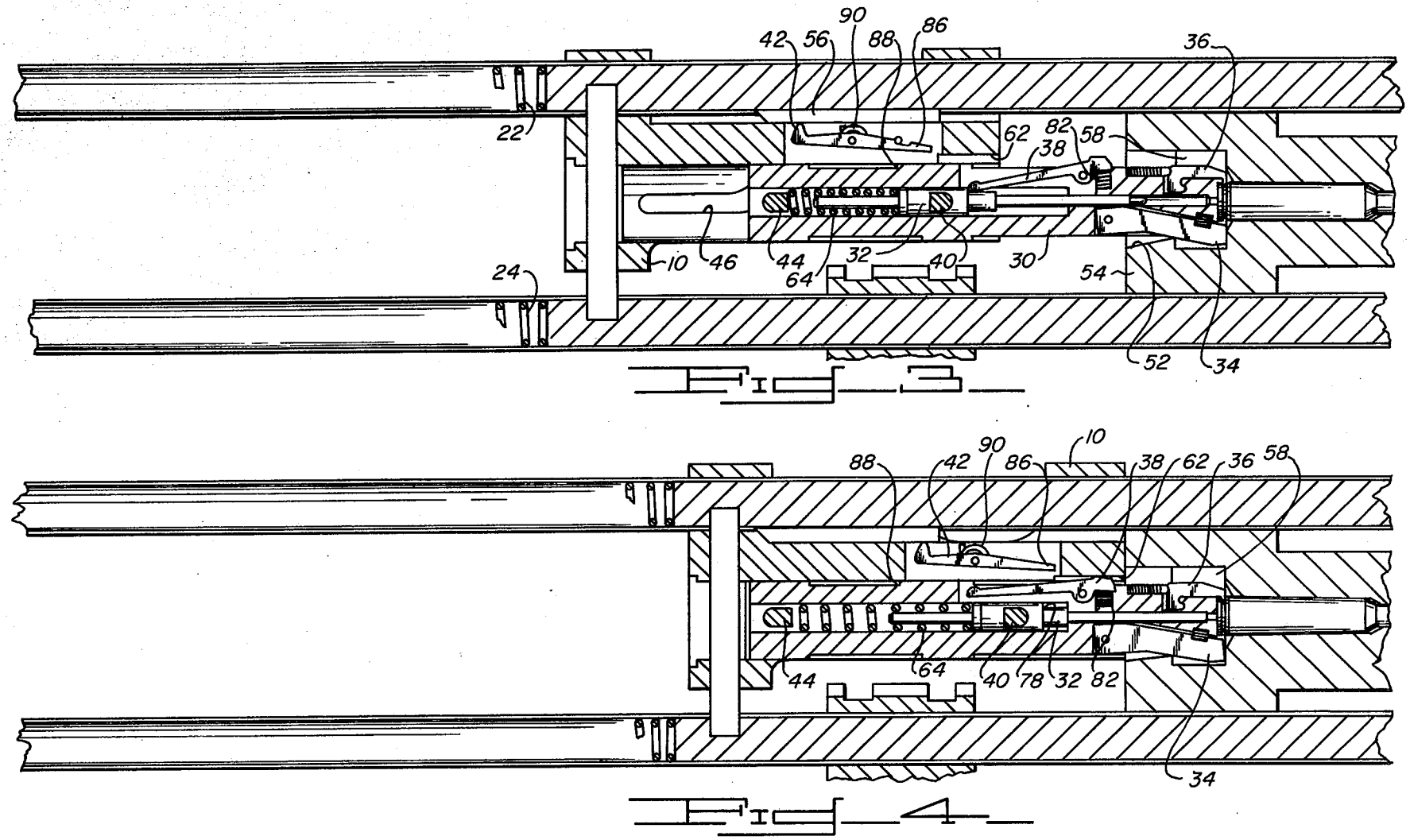
36
34
52
58
54
82
38
30
62
86
40
88
32
90
56
44
64
42
46
10
22
24
58
36
62
34
38
10
82
32
86
78
90
40
42
64
88
44

AUTOMATIC WEAPON FIRING MECHANISM

GOVERNMENT INTEREST

The invention described herein may be manufactured and/or used by or for the Government for governmental purposes without the payment of any royalty thereon.

RELATED CASES

This application is a continuation-in-part of copending application Ser. No. 610,024 filed 3 Sept. 1975 now U.S. Pat. No. 3,999,461 for Modular Lightweight Squad Automatic Weapon System of which applicant is a co-inventor. This application became U.S. Pat. No. 3,999,461 issuing on 28 Dec. 1976.

BACKGROUND OF THE INVENTION

It is typical of machine guns and other automatic weapons that the firing mechanisms are complex and intricate structures. The large number of parts required increases the initial cost of production and raises the possibility of part failure. Weight is also a critical factor which may be increased by a complex firing mechanism.

Individual types of firing mechanisms incur problems common to that specific type of mechanism. Hammer actuated firing mechanisms, for example, are susceptible to misfires caused by light hammer strikes. This can be caused by a number of reasons. Excessive bolt carrier bounce can rob the hammer of sufficient energy and thus cause a light strike. A weak or broken hammer spring or foreign particles in the hammer mechanism could also be the cause of misfires which result from light hammer strikes. Inertia type firing mechanisms may incur similar problems. In this type of mechanism the operating rod, driven by the main action spring, impacts the firing pin to detonate a round. A weak or broken action spring, foreign matter anywhere in the mechanism, or poor lubrication might be the cause of a misfire in a system of this type. In all firing mechanisms the greater the number of parts, the lesser is its reliability and the greater is its replacement of worn or broken parts and time spent in maintaining the weapon. Hence, developing a reliable firing mechanism with a minimum of parts is always a challenge.

SUMMARY OF THE INVENTION

The present invention incorporates a striker type firing mechanism. That is, the firing pin is actuated by a separator spring which gives the firing pin a constant impact velocity. In this system, misfires due to light strikes are virtually eliminated.

The automatic weapon firing mechanism of the present invention comprises a bolt carrier slideably mounted on the upper tube of the weapon described in the parent application. Springs drive it forward to battery or firing position and gases from the previous spent cartridge (or hand charger operation) move it back to recoil position. The bolt carrier carries a bolt and, by means of a cam slot on the carrier cooperating with a bolt cam pin on the bolt, the bolt rotates when in battery position to lock the bolt to the barrel extension for firing and to unlock it for recoil.

When the bolt is locked, the bolt carrier continues its forward movement, permitting a sear actuator thereon to pass over and trip the firing pin sear, which is pivotally mounted on the bolt. The firing pin is spring driven forwardly to strike and detonate the cartridge.

The firing pin is returned to the seared position during recoil by a pin which passes through the firing pin and engages another cam path on the bolt carrier. When the bolt carrier has moved a predetermined amount relative to the bolt, the spring urged firing pin sear on the bolt snaps down to retain the firing pin in the seared or cocked position. At about the same time, the rotary bolt has rotated sufficiently to disengage the bolt lugs from the barrel extension. As the carrier progresses further rearwardly, the bolt sear engages the bolt to lock the bolt and carrier together. The bolt and carrier continue rearward movement until the buffer is impacted. During this movement the spent cartridge case is ejected. Counterrecoil movement is then initiated by the action springs. A rew round is pushed forward toward the weapon chamber as the counterrecoil movement progresses. As the round is chambered, the bolt sear is released, allowing relative movement between the bolt and carrier. The bolt is rotated by the locking cam to lock the bolt to the barrel extension for firing of the cartridge round. Within the last ⅛ inch of counterrecoil movement, the firing pin sear is released. This action detonates the round and initiates a new cycle.

BRIEF DESCRIPTION OF THE DRAWINGS

FIG. 1 is a sectional view of the firing mechanism in the cocked or charged position;

FIG. 2 is a view similar to that of FIG. 1 showing the next sequential step with a round being chambered;

FIG. 3 is a similar sectional view showing the next sequential step with the bolt seared off and the locking lugs engaging the barrel extension and with the bolt rotating to locked position for the firing of the cartridge;

FIG. 4 is a similar sectional view in which the firing pin has been seared off for igniting the round.

DETAILED DESCRIPTION OF THE ILLUSTRATIVE EMBODIMENT

Figure 5:
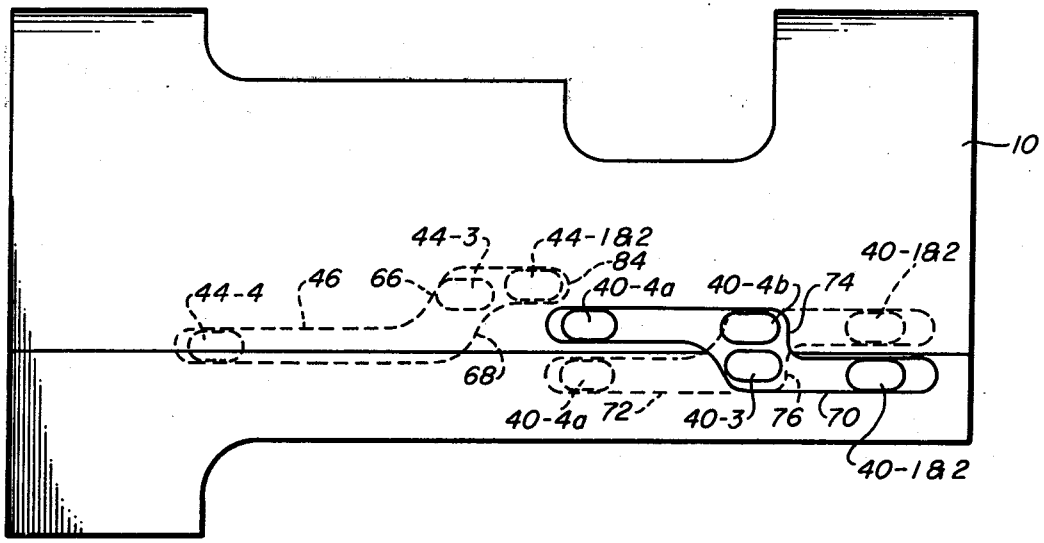
FIG. 5 is an elevational view of the bolt carrier showing the cam paths for searing the firing pin and locking the bolt to the barrel extension.

Reference is now made to FIG. 1 wherein there is shown a bolt carrier 10 adapted to move longitudinally from charged or cocked position as shown to a battery position such as shown in FIG. 4. This bolt carrier, in one form, is adapted to operate in the Modular Lightweight Squad Automatic Weapon System shown and described in copending U.S. Pat. application Ser. No. 610,024 filed 3 Sept. 1975, now U.S. Pat. No. 3,999,461, wherein the bolt carrier is attached to a pair of rods 12, 14 in tubes 16, 18. A bolt carrier 10 rides on tube 16 and is connected to the rods 12, 14 by means of a drive pin 20. Springs 22, 24 drive the rods 12, 14 forwardly whereas gas from the previous spent cartridge drives the rods 12, 14 rearwardly upon recoil. Also, a charging handle (not shown) may be used to drive rods 12, 14 rearwardly to initiate the firing operation. These rods 12, 14 are held rearwardly in the position shown by a trigger structure (not shown, but described in the copending application). A sprocket structure 26 rotates about the lower tube 18 for the purpose of feeding cartridges to the chambering position, shown in FIG. 1 by cartridge 28. The bolt carrier 10 has a bolt 30 thereon which has a firing pin 32, cartridge rammer 34, cartridge ejector 36, and firing pin sear 38 mounted thereon. Firing pin 32 has a firing pin cocking pin 40 attached thereto. Carrier 10 also has a bolt sear pivotally mounted thereon to permit relative movement between the bolt and the carrier when the bolt has been locked in battery position and the bolt carrier continues forward movement to sear off the firing pin. Cartridge 28 is chambered upon forward movement of the bolt 30 by rammer 34 as can be seen in the sequential views FIGS. 1–4. After firing and as the bolt and carrier recoil, the extractor 36 extracts the spent cartridge case and ejects it from the weapon in a conventional manner. All of the foregoing operations will be more clearly explained in reference to the sequential views as will be described hereinafter.

It is herein noted that the bolt 30 rotates somewhat because of the bolt cam pin 44 following the curvature of cam slot 46 shown in FIG. 5. To the extent that this bolt cam pin moves up or down in the slots 46 in FIG. 5, there will be slight inaccuracy in the views 2, 3 and 4. However, for purposes of clarity, these views are shown as if the bolt has not rotated.

FIG. 2 shows the relationship of the parts after the trigger (not shown) has been squeezed and springs 22 and 24 are driving rods 12 and 14 in the direction of arrow 48. At this point, rammer 34 has engaged cartridge 28 and moved the front portion thereof 50 up a ramp 52 on barrel extension 54 toward its chambered position. At this point in time, the firing pin sear and the bolt sear have not been actuated.

As the bolt carrier 10 continues its movement in a direction from left to right, the bolt sear 42 will engage ramp 56 as shown in FIG. 3. This permits bolt 30 to chamber the cartridge 28 and to reach battery position as shown while enabling the bolt carrier 10 to continue further movement. Because of the bolt cam pin 44 engagement in cam slot 46 of the bolt carrier, it rotates the bolt in battery position as the bolt carrier continues its forward movement. This locks the bolt in battery position as its lugs 58 fit into lug receiving cavities 60 in the barrel extension 54.

As the bolt carrier continues its forward movement, it has an actuator 62 thereon that engages firing pin sear 38 to sear it off and thus release the firing pin 32 for detonation of the cartridge 28. A firing pin 32 is urged forwardly by its own firing pin spring 64. Because the firing pin has its own impact spring, it has a more constant impact velocity and therefore the percentage of misfires caused by light strikes is drastically reduced.

The cam actuation for the rotation of the bolt 30 and for the cocking of the firing pin is shown in FIG. 5. The locking slot 46 is shown in dashed lines since it is on the opposite side of bolt carrier 10 from the viewer. The position of the bolt cam pin is shown in the several positions. For example, the bolt cam pin is designated as 44-1 and 2 to show its positions in FIG. 1 and FIG. 2. It is designated 44-3 to show its position in FIG. 3. It is shown as 44-4 to identify its position in FIG. 4. Thus, when the bolt carrier has reached the position shown in FIG. 3, the locking cam pin 44 engages edge 66 of slot 46 and bears downwardly as it moves forwardly to the position shown in FIG. 4 and designated 44-4. On return it bears against the opposite surface 68 to counterrotate the bolt so that it may be free to move rearwardly. The firing pin is cocked by firing pin cocking pin 40 which engages slots 70 and 72 on opposite sides of the bolt carrier 10. The firing pin cocking pin slots 70 and 72 are mirror images of each other. The firing pin cocking pin as shown in FIGS. 1 and 2 are shown in FIG. 5 and designated 40-1 and 2. As the bolt reaches battery position and is rotated while the bolt carrier continues further movement, the firing pin cocking pin is in position shown as 40-3. As the locking pin is moving from its 44-3 position to its 44-4 position, the firing pin locking pin 40-3 is moving upwardly in slot 70 without engagement with the slot edge and it moves to the position shown as **40-4*a*. This occurs just before the firing pin sear 38 is seared off by its contact with the bolt carrier actuator 62, and when that occurs, then the firing pin cocking pin moves forwardly to the position shown as 40-4*b*. So far, the slot 70 has been merely to provide clearance for the firing pin cocking pin. Now, upon recoil, as the bolt carrier moves rearwardly under gas pressure on rods 12, 14, and before the bolt has been removed from its battery position, the firing pin cocking pin 40 engages the vertical surface 74, 76 of slots 70, 72. This causes the firing pin to travel rearwardly along with the bolt carrier while the bolt remains still and locked in the battery position. Thus, as pin 32 is moving rearwardly relative to the firing pin sear 38, the searing surface 78 will pass under the end 80 of firing pin sear 38 whereupon, due to the action of spring 82, the pin becomes seared again and remains in the relative position with the bolt as shown in FIGS. 1, 2 and 3. As the bolt continues rearwardly, it unlocks the bolt in the manner previously described and causes the bolt to rotate downwardly as shown in FIG. 5 and causes the firing pin cocking pin to move from edges 74, 76 and thus free to return to its position 40-1 and 2. As the bolt carrier continues its recoil movement, the bolt cam pin abuts the end 84 of locking slot 46 and thus firmly moves the bolt with the bolt carrier. This relative position of the bolt with the carrier permits end 86 of bolt sear 42 to engage a bolt sear surface 88 on the bolt 30. Sear 42 is urged by sear bolt spring 90 to rotate to this position. This then provides the relative positioning of the bolt carrier as shown in FIGS. 1 and 2. Thus the complete cycle has been made and the structure is again in the position shown in FIG. 1**.

While the speed of cycling or the cycling rate depends upon a number of factors, such as the gas recoil pressure on the rods or the strength of the springs and other factors, in the present embodiment the cyclic rate is on the order of 600 rounds per minute.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. An automatic weapon firing mechanism comprising:

a bolt carrier slideably movable between recoil and battery positions, said carrier being spring driven to battery position and returnable to recoil position by gases from a previously fired cartridge, a bolt movable rotatably and longitudinally on said carrier, said bolt having a cam pin, said carrier having a cam slot receiving said pin whereby relative longitudinal movement between said bolt and carrier causes rotational movement of said bolt, a firing pin mounted for longitudinal movement on said bolt, spring means urging said firing pin forwardly on said bolt, a firing pin sear mounted on said bolt and adapted to releasably retain said firing pin in a cocked position in opposition to said spring means, a firing pin cocking pin on said firing pin, said carrier having cam slots receiving said cocking pin whereby rearward movement of said carrier returns said firing pin to cocked position.

2. An automatic weapon firing mechanism as in claim 1 wherein said relative longitudinal movement between said carrier and said bolt occurs when said bolt has chambered a cartridge and said bolt is in battery position.

3. An automatic weapon firing mechanism as in claim 2 wherein said bolt has locking lugs thereon and a barrel extension is provided with cooperating cavities whereby said locking lugs are rotated in said cavities to lock said bolt in battery position by continued forward movement of said carrier and said locking lugs are rotated to unlock said bolt by rearward movement of said carrier.

4. An automatic weapon firing mechanism as in claim 1 wherein said carrier has a sear actuator thereon to sear off said firing pin sear upon forward movement of said carrier relative to said bolt.

5. An automatic weapon firing mechanism as in claim 1 wherein said carrier has a bolt engaging sear thereon for moving said bolt to battery position upon forward movement of said carrier, and means for disengaging said sear from said bolt to permit further forward travel of said carrier when said bolt has reached its battery position.

6. An automatic weapon firing mechanism as in claim 1 wherein said carrier is connected by a drive pin to gas operable rods in tubes comprising part of the weapon with which said firing mechanism is operable.

7. An automatic weapon firing mechanism as in claim 5 wherein said carrier moves on a tube and said means for disengaging said sear is a sear engaging ramp on said tube.

8. An automatic weapon firing mechanism as in claim 1 wherein said bolt has a spring biased extractor and rammer pivotally mounted thereon whereby a cartridge may be chambered and extracted by said bolt.

* * * * *